US008371446B2

(12) United States Patent
Tschantz

(10) Patent No.: US 8,371,446 B2
(45) Date of Patent: Feb. 12, 2013

(54) SECURELY SEALED INFLATION VALVE FOR INFLATABLE PACKAGING

(76) Inventor: Michell C. Tschantz, Newtown, CT (US)

( * ) Notice: Subject to any disclaimer, the term of this patent is extended or adjusted under 35 U.S.C. 154(b) by 337 days.

(21) Appl. No.: 12/462,856

(22) Filed: Aug. 10, 2009

(65) Prior Publication Data

US 2010/0038275 A1 Feb. 18, 2010

Related U.S. Application Data

(60) Provisional application No. 61/188,818, filed on Aug. 12, 2008.

(51) Int. Cl.
*B65D 81/03* (2006.01)

(52) U.S. Cl. ..... 206/522; 383/3

(58) Field of Classification Search ..... 206/522, 206/591, 594, 521; 383/3, 52
See application file for complete search history.

(56) References Cited

U.S. PATENT DOCUMENTS 5,459,978 A * 10/1995 Weiss et al. ..... 53/425
5,770,287 A * 6/1998 Miranda et al. ..... 428/40.1
6,189,694 B1 * 2/2001 Weiss et al. ..... 206/484.1
6,251,489 B1 * 6/2001 Weiss et al. ..... 428/35.2
6,571,954 B2 * 6/2003 Nadler ..... 206/522
7,290,970 B2 * 11/2007 Deonarine ..... 410/119
2008/0035519 A1 * 2/2008 Swartz et al. ..... 206/522

* cited by examiner

*Primary Examiner* — Andrew Perreault
(74) *Attorney, Agent, or Firm* — Ware, Fressola, Van Der Sluys & Adolphson LLP

(57) ABSTRACT

An inflatable valve for an inflatable packaging cushion has first and second juxtaposed plys of thermoplastic material secured together by first and second spaced-apart heat sealed side seams to form a flattened tube having an interior sealing end positioned in an inflatable packaging cushion and an inflation probe insertion end positioned exteriorly of the inflatable packaging cushion. An adhesive strip is applied to the second ply and extends between the heat sealed side seams. Release paper covers the adhesive strip; wherein the release paper is removed and the first and second plys are pressed together, the adhesive strip seals the first and second plys together. Spot seals at the intersections of the heat sealed side seals and the adhesive strip sealingly join the side seals and the adhesive strip. The adhesive strip is provided by one side of a two-sided adhesive tape or as a layer of adhesive. The first ply only partially overlies the adhesive strip, wherein when the release paper is removed, a portion of the adhesive strip is exposed and may be used to secure the inflation end of the inflation valve to the inflatable packaging cushion.

18 Claims, 4 Drawing Sheets

SECURELY SEALED INFLATION VALVE FOR INFLATABLE PACKAGING

RELATED APPLICATIONS

This application claims priority to my U.S. Provisional Application Ser. No. 61/188,818 filed Aug. 12, 2008.

FIELD OF INVENTION

This invention relates to an inflation valve for admitting an inflation probe to an inflatable packaging cushion wherein the inflation valve is securely sealed after removal of the inflation probe.

BACKGROUND OF INVENTION

Inflatable packaging cushions are in widespread and growing usage. They have the advantage of lightweight and reduced volume in their uninflated condition, and also conform and adapt to voids in packaging that need to be filled to secure the contents of the packaging. Inflatable packaging cushions require a valve to admit inflation air. It is important that this valve seal securely after inflation, so that the inflatable packaging cushion will reliably protect contents of a package during handling and shipping.

One type of inflation valve for inflatable packaging cushions comprises two juxtaposed plys of thermoplastic sheet material, forming a flattened tube. The inflation valve is secured through the edge of and extends into an inflatable packaging cushion, and may be opened to insert an inflation probe for inflating the packaging cushion. When the probe is removed, air pressure within the inflated packaging cushion presses the two plys of the inflation valve together, which seals the valve. Although this type of inflation valve is generally reliable, it can sometimes leak. In particular, leaks may be caused by manipulation and distortion of the portion of the inflation valve deployed on the exterior of the inflated packaging cushion.

Despite this occasional drawback, this inflation valve has many advantages, including ease of incorporating it into an inflatable packaging cushion and ease of inflation.

Therefore, it would be an advance in the art if the aforesaid advantages of the two-ply inflation valve could be attained but the inflation valve could be made more reliable.

SUMMARY OF THE INVENTION

Accordingly, it is a principal object of the invention herein to provide a two-ply inflation valve for use in inflatable packaging cushions that has a high degree of reliability in its sealing function.

It is another object of the invention herein to provide such an inflation valve that retains the benefits of ease of incorporation into inflatable packaging cushions and ease of inflation.

In carrying out the foregoing and other objects of the invention, a two-ply inflation valve for incorporation into an inflatable packaging cushion has an interior end and an exterior inflation probe insertion end. One of the plys has a strip of adhesive adhered thereto and extending across the ply, adjacent to the exterior end thereof. The adhesive strip is covered with release paper during storage and inflation of the packaging cushion. After the packaging cushion has been inflated by inserting a probe through the inflation valve, the probe is withdrawn and the interior end of the two-ply inflation valve is sealed by air pressure acting to force the plys together. The exterior end of the inflation valve is secondarily sealed by removing the release paper from the adhesive strip, thereby exposing the adhesive strip which then adheres to the other ply to provide a secondary seal.

In one aspect of the invention, the strip of adhesive is provided as one side of a two-sided adhesive tape. One of the adhesive sides of the two-sided adhesive tape secures the adhesive tape to the ply and the other adhesive side provides the adhesive strip that is covered by release paper until used to form the secondary seal. The adhesive strip may also be applied directly to the ply, covered by release paper until used.

In an additional aspect of the invention, the adhesive is an acrylic copolymer adhesive, which resists degradation when exposed to moisture.

In other aspects of the invention, the two plys of the inflation valve are non-conterminous at the exterior inflation probe insertion end. The longer ply has the adhesive strip applied thereto prior to inflation, and the shorter ply overlies a portion of the adhesive strip and the release paper covering it. After inflation, the release paper is removed and the shorter ply is adhered to the longer ply by a portion of the adhesive strip. A remaining exposed portion of the adhesive strip on the longer ply permits the inflation valve to be folded over and secured to the outside of the inflated packaging cushion.

In further aspects of the invention, the two plys of the two-ply inflation valve are heat sealed together along their marginal edges and the heat seal seams extend to the adhesive strip. A supplemental heat seal spot is formed at the intersection of each of the seams and the adhesive strip to secure against leakage at this junction.

Other and more specific objects and features of the invention herein will in part be recognized by those skilled in the art and will in part appear in the following detailed description of the invention taken together with the drawings.

BRIEF DESCRIPTION OF DRAWINGS

The same reference numerals refer to the same elements throughout the various Figures.

DETAILED DESCRIPTION OF INVENTION

Figure 1:
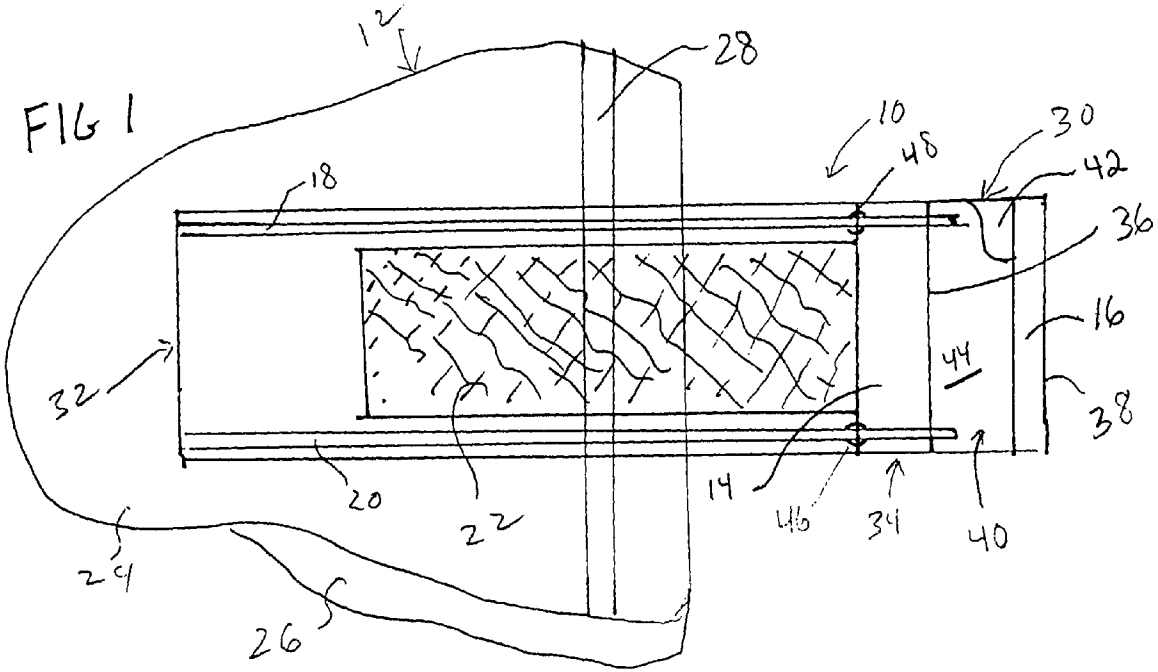
FIG. 1 is a plan view of an inflation valve according to the invention herein, secured in the edge of an inflatable packaging cushion.

With reference to FIG. 1, an inflation valve 10 according to the invention herein is shown mounted in an inflatable packaging cushion 12 prior to inflation of the inflatable packaging cushion 12. The inflation valve 10 is a two ply structure, having a first layer or ply 14 and a second layer or ply 16 made of thermoplastic material such as polyethylene or polypropylene The first and second plys 14, 16 are juxtaposed and secured together along their marginal edges by first and second heat sealed side seams 18 and 20, such that the inflation valve 10 has the general configuration of a flattened tube.

Figure 2:
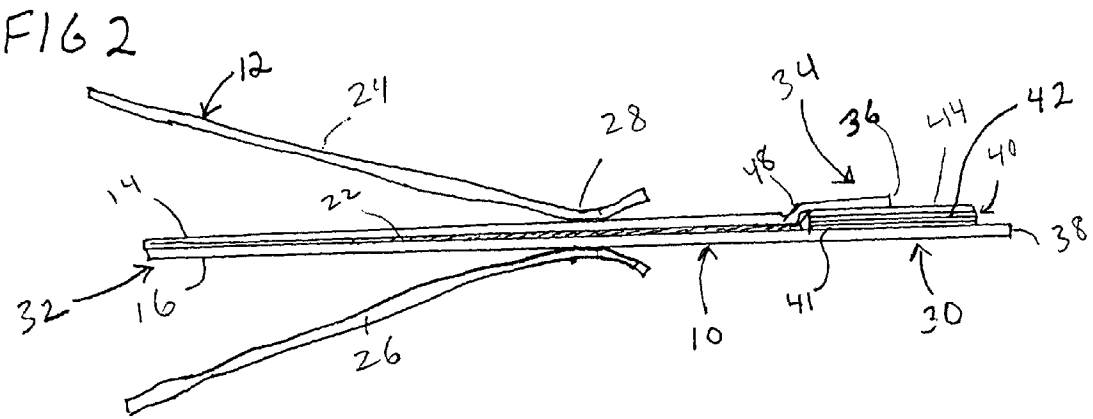
FIG. 2 is a sectional view of the inflation valve of FIG. 1 taken along the lines 2-2 of FIG. 1.

The inside surface of the upper ply 14 has a heat resistant coating 22 deposited thereon. The heat resistant coating 22 may be deposited on the inside surface of the lower ply 16, if desired. The inflation valve 10 is placed between the layers 24 and 26 of the inflatable packaging cushion 12, and an edge seam 28 secures the layers 24 and 26 together and also secures the inflation valve 10 to the inflatable packaging cushion 12 by means of the portion of the edge seam 28 passing over and under the inflation valve 10, as seen in FIGS. 1 and 2. The heat resistant coating 22 prevents the two plys 14 and 16 from being heat sealed together at edge seam 28, so that the inflation valve 10 may be opened for inflating the packaging cushion 12.

Inflation valve 10 has an inflation probe insertion end 30 exterior of the packaging cushion 12 and an interior sealing end 32 within the inflatable packaging cushion 12. When the packaging cushion 12 is inflated, air pressure within the packaging cushion 12 presses the two plys 14 and 16 together at the interior sealing end 32 and extending to the edge seam 28, which closes and seals the inflation valve 10 as a primary seal.

Figure 3:
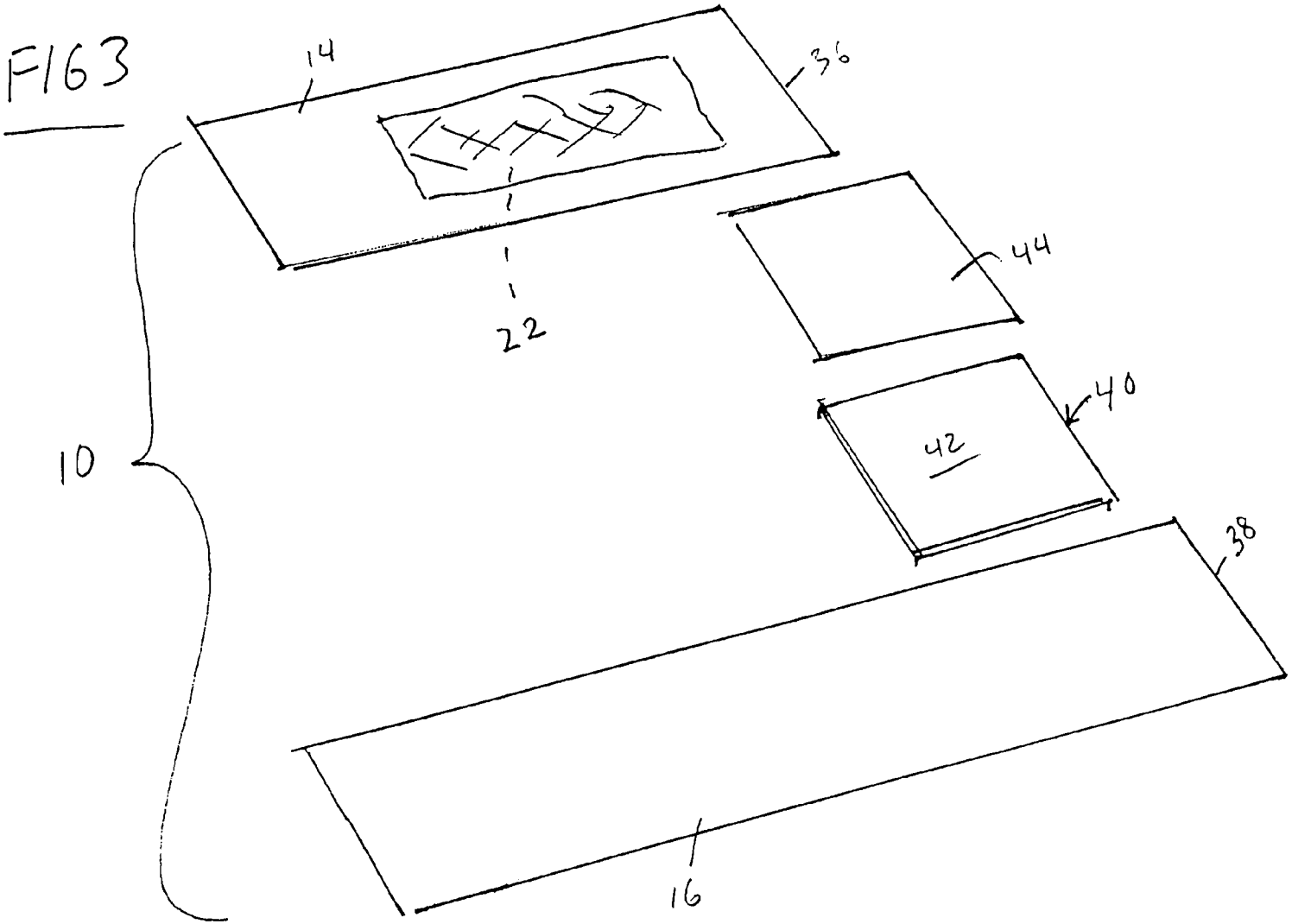
FIG. 3 is an exploded perspective view of the inflation valve of FIG. 1.

The inflation valve 10 is characterized by a secondary sealing structure, generally indicated at 34. With reference to FIGS. 1-3, the lower second ply 16 of the inflation valve 12 is longer than the first ply 14. The plys 14, 16 are aligned at the interior sealing end 32 of the inflation valve 10, and are non-coterminous at the inflation probe insertion end 30, with the end 36 of first ply 14 offset toward the packaging cushion 12 from the end 38 of the second longer ply 16.

A two-sided adhesive tape 40 is adhered to the lower, second ply 16 by its underside adhesive 41. The adhesive tape may be a tape identified by product number 1210 XL of the International Tape Company. An upperside adhesive strip 42 of the adhesive tape 40, which faces outwardly from the ply 16, is covered by release paper 44 prior to inflation of the packaging cushion 12 and secondary sealing of the inflation valve 10. The adhesive strip 42 extends across the inflation valve 10, i.e. it fully spans between side seams 18 and 20. The adhesive strip 42 and release paper 44 are preferably positioned spaced inwardly from the end 38 of ply 16, and the end 36 of the shorter ply 14 is preferably positioned approximately halfway along the adhesive strip 42 and release paper 44. The heat resistant coating 22 on the underside of the first ply 14 may terminate adjacent the adhesive tape 40, although this is not functionally necessary.

In making inflation valve 10, the two-sided adhesive tape 40 with adhesive strip 42 covered by release paper 44 is positioned on and adhered to the longer ply 16 by underside adhesive 41. The shorter ply 14 is positioned with end 36 partially overlying the release paper 44 and the side seams 18 and 20 are formed securing the plys 14 and 16 together. It will be noted that the side seams 18 and 20 are formed extending into the adhesive strip 42 where it is covered by the release paper 44. Although these extended portions of the side seams 18, 20 do not secure the plys 14, 16 together because of the release paper 44, the extensions insure that the side seams 18 and 20 form a sealing juncture with the underside adhesive 41 and the adhesive strip 42 of the adhesive tape 40. Additionally, a second supplemental heat sealing step is preferably carried out to form sealing spots 46 and 48 at the juncture of the side seams 18 and 20 and the adhesive tape 40, to assure a sealed junction where the seams 18, 20 join the adhesive of the adhesive tape 40. This sealing function is carried out while the release paper is on the adhesive strip 42, and seals any discontinuities so that the side seams 18, 20, the adhesive tape 40 and the adhesive thereof form a continuous sealing barrier.

Figure 8:
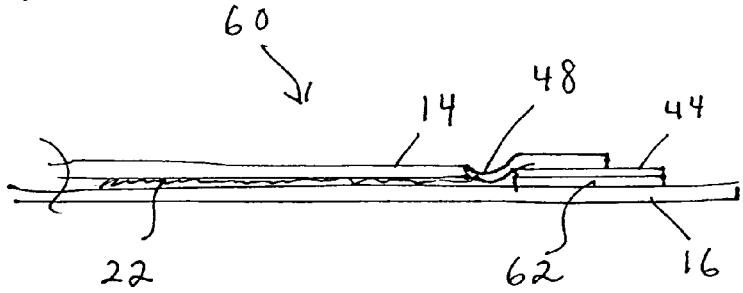
FIG. 8 is a side view of another inflation value according to the invention herein.

It should also be noted that although the inflation valve 10 is illustrated with a two-sided adhesive tape 40 providing the adhesive strip 42, it is also suitable to provide an adhesive strip in the form of an adhesive on a release paper, such that an adhesive strip may be applied directly to the ply 16 and remain on the ply 16 when the release paper is removed, similar to the removal of release paper 44 described below. This is shown in FIG. 8 which is a sectional view of inflation valve 60, having adhesive strip 62 applied directly to the lower ply 16 and covered by release paper 44.

The adhesive used in the International Tape Company 1210 XL tape, and used in forming an adhesive strip 62 with release paper instead of double-sided tape 40, is an acrylic-base copolymer adhesive that resists degradation by water or water vapor. It is preferably blend R30 of the International Tape Company. It will be appreciated that compressed air used to inflate the packaging cushion 12 may have a high moisture content, which would weaken many adhesives over time. Acrylic-based adhesives are moisture resistant and are able to maintain a good seal under these conditions.

The inflation valve 10 is fabricated by first positioning the two-sided adhesive tape 40 with adhesive strip 42 and release paper 44 on the lower ply 16, and forming the side seams 18 and 20. The spot seals 41, 48 are formed at the same time. The valve 10 is then inserted between layers 24, 26 of the inflatable packaging cushion 12, and edge seam 28 is formed to secure the layers 24, 26 together and mount the valve 10. Inflation valve 60 of FIG. 8 is similarly fabricated, except that the adhesive strip 62 is carried on release paper 44 and applied directly to ply 16.

Figure 4:
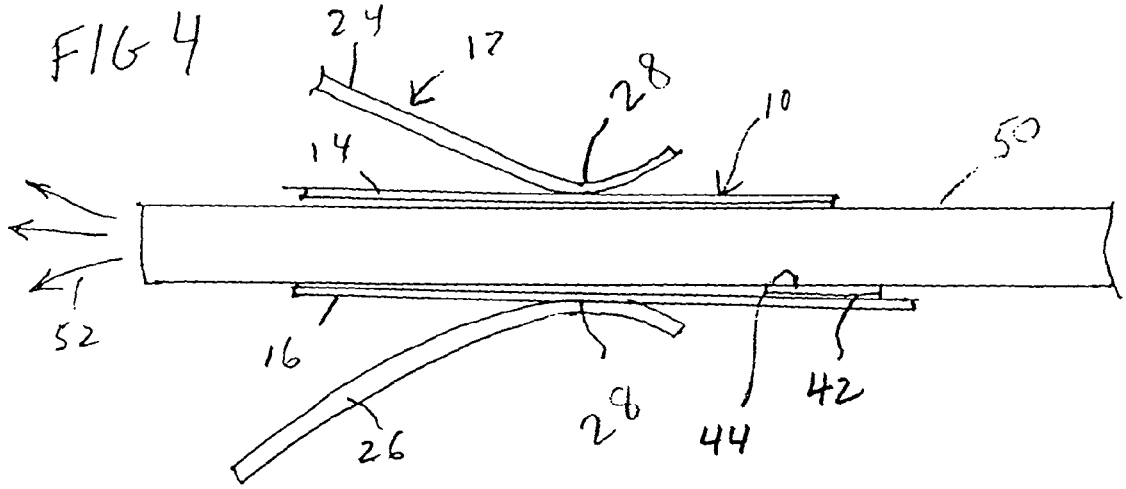
FIG. 4 is a side view of the inflation valve of FIG. 1, with an inflation probe inserted therethrough.
Figure 5:
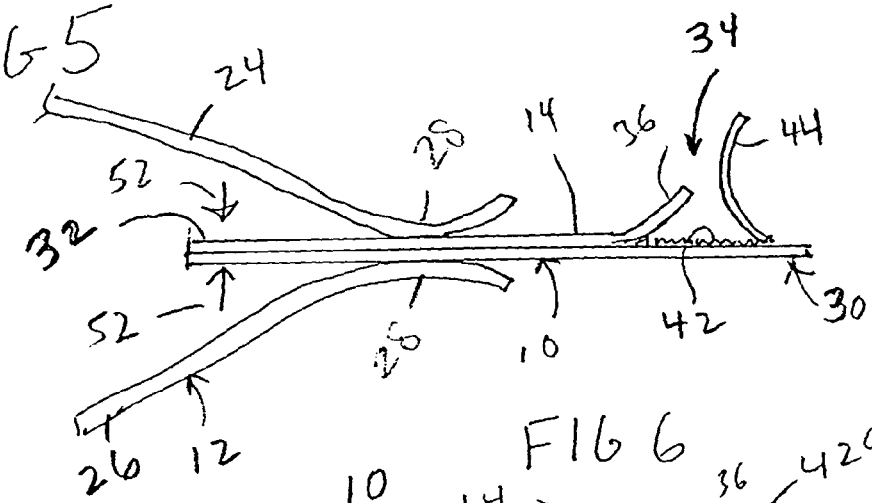
FIG. 5 is a side view of the inflation valve of FIG. 1, after the inflation probe has been removed and showing a section of release paper being removed.
Figure 6:
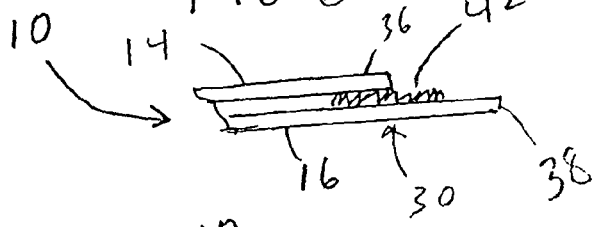
FIG. 6 is a fragmentary side view of the inflation valve of FIG. 1, with the two plys of the inflation valve adhered together.

FIGS. 4-7 illustrate the use of the inflation valve 10. It will be appreciated that use of inflation valve 60 is similar. In FIG. 4, the inflation probe 50 is inserted between the plys 14 and 16 of the inflation valve 10 to introduce air 52 between the layers 24 and 26 of the packaging cushion 12. Once inflation of the packaging cushion 12 is achieved, the probe 50 is withdrawn. As illustrated in FIG. 5, after the probe 50 is withdrawn, the inflation air 52 acts on the interior sealing end 32 and the adjacent portion of the inflation valve 10, providing a first primary seal. At the inflation probe insertion end 30, the release paper 44 is peeled back to expose the adhesive strip 42. The end 36 of ply 14 may be lifted to remove the release paper, as the release paper prevents the plys 14 and 16 from adhering in the area of the release paper. The end 36 of the ply 14 is then pressed onto ply 16 and is secured to the lower ply 16 by the adhesive strip 42, as illustrated in FIG. 6. This forms a secondary seal blocking the release of any air that leaks past the primary seal.

Figure 7:
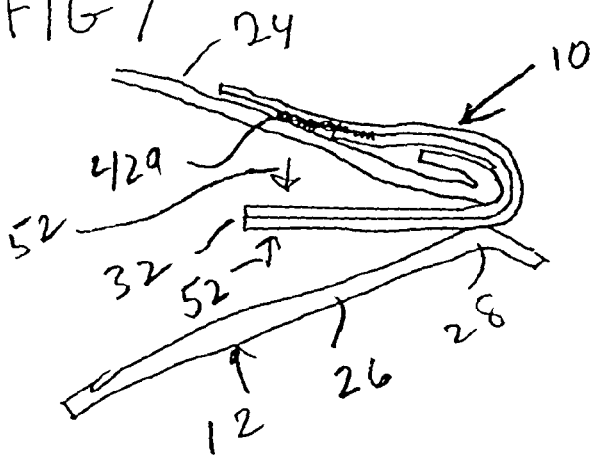
FIG. 7 is a side view of the inflation valve in FIG. 1, with the release paper removed and the inflation valve adhered to the inflatable packaging cushion in which it is incorporated.

As also illustrated in FIG. 6, a portion 42*a* of the adhesive strip 42 remains exposed beyond the end 36 of ply 14. As illustrated in FIG. 7, the portion of the inflation valve 10 extending outside the inflatable packaging cushion 12 is folded over and adhered to layer 24 of the packaging cushion 12 by means of the exposed portion 42*a* of adhesive strip 42. This further secures the secondary seal of the inflation valve 10, because the two plys 14 and 16 are secured together in a sealed relationship by the adhesive 42 with additional sealing provided by securing ply 16 to layer 24 of the packaging cushion 12. Also, the folded configuration of the inflation valve 10 holds the inflation valve 10 close to the packaging cushion 12, and prevents the inflation valve 10 from being distorted and thereby disturbing the sealing functions. If the seal at end 32 of the inflation valve 10 were to leak, the folded configuration also limits the pressure that is applied to the secondary seal at the inflation probe insertion end 30 of the inflation valve 10, also to better maintain good sealing.

Accordingly, an inflatable packaging cushion with a securely sealed double-sealed inflation valve has been described that admirably achieves the objects of the invention. It will be appreciated that the embodiments described are illustrative of the invention, but that modifications may be made without departing from the spirit and scope of the invention.

I claim:

1. An inflation valve for introducing inflation air into an inflatable packaging cushion and maintaining the inflatable packaging cushion in an inflated condition the inflation valve comprising:

(a) first and second juxtaposed plys of thermoplastic material;

(b) first and second spaced apart heat sealed side seams securing the first and second plys together in the form a flattened tube having an interior sealing end of the inflation valve for positioning in an inflatable packaging cushion and an inflation probe insertion end of the inflation valve for positioning exteriorly of an inflatable packaging cushion;

(c) an adhesive strip applied to the second ply adjacent the inflation probe insertion end of the flattened tube and extending between the first and second heat sealed side seams, the first ply positioned at least partially over the adhesive strip; and (d) release paper removably adhered to the adhesive strip; wherein when the release paper is removed and the first and second plys are pressed together, the adhesive strip seals the first and second plys together and thereby seals the inflation probe insertion end of the inflation valve.

2. An inflation valve as defined claim 1 wherein the adhesive strip is provided by a two-sided adhesive tape, one side of said two-sided adhesive tape adhered to the second ply of the inflation valve and the other side of the two-sided adhesive tape forming the adhesive strip having release paper removeably adhered thereto.

3. The inflation valve as defined in claim 2 and further comprising:

(e) first and second spot seals respectively positioned at the intersections of the heat sealed side seals and the two-sided adhesive tape, said spot seals sealingly joining the side seals and the adhesive of the two-sided adhesive tape.

4. An inflation valve as defined in claim 3 wherein the second ply to which the two-sided adhesive tape is adhered is longer than the first ply such that the first ply only partially overlies the adhesive strip and release paper when the release paper is adhered thereto, wherein when the release paper is removed and the first ply is secured to the second ply by the adhesive strip a portion of the adhesive strip is exposed and may be used to secure the inflation end of the inflation valve to the exterior of the inflatable packaging cushion.

5. The inflation valve as defined in claim 4 wherein the adhesive of the two-sided adhesive tape is an acrylic-based copolymer adhesive that resists degradation by water and water vapor.

6. The inflation valve as defined in claim 1 and further comprising:

(e) first and second spot seals respectively positioned at the intersections of the heat sealed side seals and the adhesive strip, said spot seals sealingly joining the side seals and the adhesive strip.

7. An inflation valve as defined in claim 1 wherein the second ply to which the adhesive strip is adhered is longer than the first ply such that the first ply only partially overlies the adhesive strip and release paper when the release paper is adhered thereto, wherein when the release paper is removed and the first ply is secured to the second ply by the adhesive strip, a portion of the adhesive strip is exposed and may be used to secure the inflation end of the inflation valve to the exterior of the inflatable packaging cushion.

8. The inflation valve as defined in claim 1 wherein the adhesive of the two-sided adhesive tape is an acrylic-based copolymer adhesive that resists degradation by water and water vapor.

9. The inflation valve of claim 1 wherein the adhesive strip is a layer of adhesive adhered to the second ply and covered by release paper removeably adhered thereto.

10. An inflatable packaging cushion comprising;

(a) first and second layers of thermoplastic sheet material;

(b) an inflation valve having (1) first and second juxtaposed plys of thermoplastic material secured together to form an inflatable cushion;

(2) first and second spaced apart heat sealed side seams securing the first and second plys together in the form a flattened tube having an interior sealing end of the inflation valve positioned in the inflatable cushion and an inflation probe insertion end of the inflation valve positioned exteriorly of the inflatable cushion;

(3) an adhesive strip applied to the second ply adjacent the inflation probe insertion end of the flattened tube and extending between the first and second heat sealed side seams, the first ply positioned at least partially over the adhesive strip; and (4) release paper removably adhered to the adhesive strip; and (c) the inflation valve inserted between the first and second layers of the inflatable packaging cushion and secured thereto by an edge seam of the inflatable packaging cushion extending across the inflatable valve between the interior sealing end and the inflation probe insertion end thereof; wherein when the release paper is removed and the first and second plys are pressed together, the adhesive strip seals the inflation probe insertion end of the inflation valve.

11. The inflatable packaging cushion as defined claim 10 wherein the adhesive strip of the inflation valve is provided by a two-sided adhesive tape, one side of said two-sided adhesive tape adhered to the second ply of the inflation valve and the other side of the two-sided adhesive tape forming the adhesive strip having release paper removeably adhered thereto.

12. The inflatable packaging cushion as defined in claim 11 and further co mprising:

(e) first and second spot seals respectively positioned at the intersections of the heat sealed side seals and the two-sided adhesive tape of the inflation valve, said spot seals sealingly joining the side seals and the adhesive of the two-sided adhesive tape.

13. The inflatable packaging cushion as defined in claim 12 wherein the second ply of the inflation valve to which the two-sided adhesive tape is adhered is longer than the first ply such that the first ply only partially overlies the adhesive strip and release paper when the release paper is adhered thereto, wherein when the release paper is removed and the first ply is secured to the second ply by the adhesive strip, a portion of the adhesive strip is exposed and may be used to secure the inflation end of the inflation valve to the exterior of the inflatable cushion.

14. The inflatable package cushion as defined in claim 13 wherein the adhesive of the two-sided adhesive tape of the inflation valve is an acrylic-based copolymer adhesive that resists degradation by water and water vapor.

15. The inflatable packaging cushion as defined in claim 10 and further comprising:

(e) first and second spot seals respectively positioned at the intersections of the heat sealed edge seals and the adhesive strip, of the inflation valve said spot seals sealingly joining the side seals and the adhesive strip.

16. The inflatable packaging cushion as defined in claim 10 wherein the second ply of the inflation valve to which the adhesive strip is adhered is longer than the first ply such that the first ply only partially overlies the adhesive strip and release paper when the release paper is adhered thereto, wherein when the release paper is removed and the first ply is secured to the second ply by the adhesive strip, a portion of the adhesive strip is exposed and may be used to secure the inflation end of the inflation valve to the inflatable cushion.

17. The inflatable packaging cushion as defined in claim 10 wherein the adhesive of the two-sided adhesive tape of the inflation valve is an acrylic-based copolymer adhesive that resists degradation by water and water vapor.

18. The inflatable packaging cushion of claim 10 wherein the adhesive strip of the inflation valve is a layer of adhesive adhered to the second ply and covered by release paper removeably adhered thereto.

* * * * *